United States Patent [19]

Melrose

[11] Patent Number: 4,651,668

[45] Date of Patent: Mar. 24, 1987

[54] TRAVELLER CONTROL FOR SAILCRAFT

[76] Inventor: Robert G. Melrose, 39 Robinson Rd., Greenport, N.Y. 11944

[21] Appl. No.: 782,056

[22] Filed: Sep. 30, 1985

[51] Int. Cl.[4] ..... B63B 21/24

[52] U.S. Cl. ..... 114/204; 114/112

[58] Field of Search ..... 114/39, 112, 204, 218, 114/111, 199; 24/115 R, 115 J, 115 M, 134 R, 134 P

[56] References Cited

U.S. PATENT DOCUMENTS

| | | | |
|---|---|---|---|
| 3,678,876 | 7/1972 | Alter | 114/218 |
| 3,875,889 | 4/1975 | Robbins | 114/104 |
| 3,978,809 | 9/1976 | Snyder, Jr. | 114/102 |
| 4,013,031 | 3/1977 | Viviano | 114/39 |
| 4,080,919 | 3/1978 | Holland et al. | 114/204 |
| 4,144,830 | 3/1979 | McPherren | 114/204 |
| 4,147,121 | 4/1979 | Fogh et al. | 114/204 |
| 4,319,537 | 3/1982 | Hackney | 114/218 |

*Primary Examiner*—Sherman D. Basinger
*Assistant Examiner*—Jesûs D. Sotelo
*Attorney, Agent, or Firm*—Hoffmann, Dilworth, Barrese & Baron

[57] ABSTRACT

A traveller assembly for use on sailcraft, said traveller assembly comprising a track way, a traveller car adapted to move to and fro along said track way, the traveller car provided with an engaging element; and a stop member secured to said track way, the stop member provided with an element for receiving and locking said engaging element thereby providing a convenient arrangement for remotely controlling the positioning of the traveller car and concomitantly an efficient system for tacking a sailcraft.

7 Claims, 3 Drawing Figures

TRAVELLER CONTROL FOR SAILCRAFT

BACKGROUND OF THE INVENTION

This invention relates to travellers for sailcraft and more particularly to an improved traveller assembly for positioning a sail on a sailcraft.

Many sailcraft, such as sailboats, ice boats and the like, are fitted with a traveller across the deck after the mast. With such a device, the trim of the mainsail on each tack is controlled. Numerous varieties of traveller devices are known. The simplest forms of travellers consist of a ring or sheave that slides along a rod or rope fastened to the deck of the sailcraft. More sophisticated travellers, in which class the traveller assembly of the present invention is included, consist of a track fastened generally perpendicular to the longitudinal axis on the deck or other portion of the sailcraft and a traveller car which slides along the track. The main sheet pulley is mounted on the traveller car thereby movable from side to side of the craft away from the centerline. Stops may be used to limit the movement to either side.

In order to move the traveller car and position it in the right place for any particular wind or sailing condition, control ropes are provided which are operable from each side of the craft. Such control ropes are in the majority of cases fastened in cam cleats so that once the traveller is set in a desired position it will be held there.

Sailors are very much aware of the improved performance of the sail, for example, main sail, which can be achieved by optionally adjusting the traveller car to control the angle of attack of the sail. This optimum position, however, varies with changes in the wind velocity as well as with each sailcraft design. For example, in light air, going to weather, the traveller car must be moved to weather so the boom is close to the centerline of the sailcraft. In heavy air, the traveller car may be on the centerline or all the way to leeward to help bring the craft to a more level position. These adjustments, however, become, so tedious at times that the average sailor leaves the traveller car on the centerline so that he does not need to adjust the position each time he tacks.

On the other hand, for the racing sailor, traveller car position is very important and most racing sailcraft have a control system on each side of the traveller car consisting of a tackle and a jam cleat to pull the traveller car to windward and secure it there in the desired position for the point of sail and the wind velocity existing at the time. When one tacks the boat, a control line must be released from the jam cleat and the helmsman or other crew must move to the other side of the boat and secure the opposite control line in its jam cleat before the craft passes head to wind.

Numerous traveller devices and assemblies have been devised in an attempt to overcome the aforenoted disadvantages. For example, a self-releasing traveller and cam cleat is disclosed in U.S. Pat. No. 4,147,121 wherein an attachment means is provided on the traveller car for attaching control ropes on either side thereof for controlling the position from either side of the sailboat. Cleat means are provided on either side of the traveller car for fastening the control pages. Cleat releasers are also provided on the traveller car, being movable relative to said cleat means, and being operable in response to wind pressure on, for example, the main sail to release the cleat means on one side of the said traveller car, while leaving the cleat means on the other side of the traveller car undisturbed.

Other traveller assemblies are disclosed in U.S. Pat. Nos. 3,978,809, 4,013,031, 3,678,876, 4,144,830, 4,080,919, 3,875,889 and 4,319,537. In particular, U.S. Pat. No. 4,319,537 discloses a sailcraft traveller car and assembly adapted to enable traveller positioning to be controlled from a position on the sailcraft remote from the traveller. This device comprises a car for a traveller track, the car slotted to ride in the traveller track and having a pair of transverse major holes in the middle thereof and a transverse minor hole on each end. A sheet for a sail of the sailcraft is bent to one of the major holes and reeved via the the sail through the major hole. Lines bent to the minor holes permit positioning of the car along the track to be controlled from a position on the sailcraft remote from the traveller.

None of these prior art traveller devices, however, overcomes the necessity of adjusting the stops or control lines every time tacking is required.

SUMMARY OF THE INVENTION

Accordingly, one object of the present invention is to provde an improved traveller assembly for sailcraft.

Another object of this invention is to provide an improved traveller assembly to enable traveller positioning to be controlled from a position on the sailcraft remote from the traveller.

A further object of the invention is to provide a traveller control which simplifies the tacking operation on a sailcraft.

A still further object of this invention is to provide a traveller assembly which overcomes the necessity of adjusting the stops and/or control lines every time tacking is required.

These and other objects are achieved herein by providing a traveller assembly having a track way, a traveller car adapted to move to and fro along the track way, attachment means on the traveller car for attaching control ropes and stops adapted to be secured to said track way, said traveller car provided with engaging means and said stops provided with means for receiving said engaging means.

DETAILED DESCRIPTION OF THE INVENTION

Figure 1:
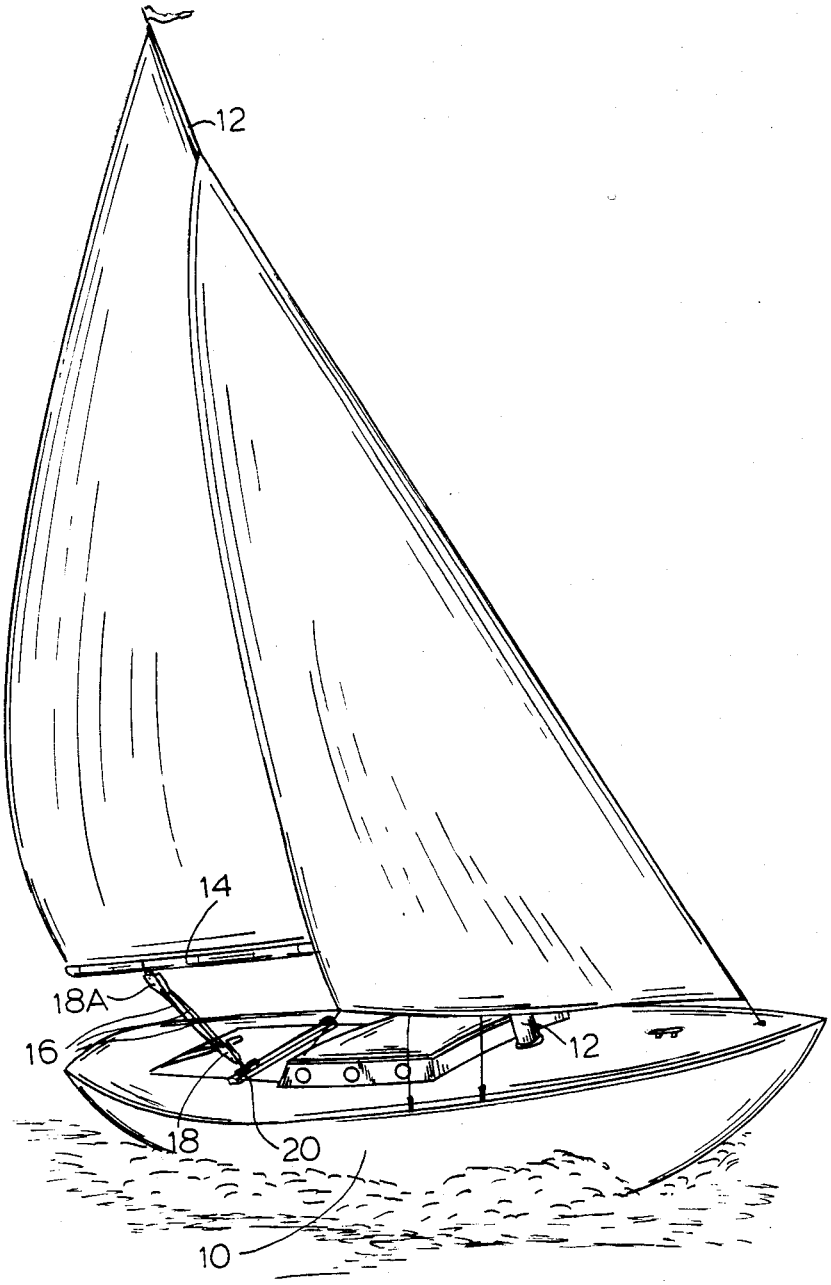
FIG. 1 is a perspective view of a sailboat and illustrates the relationship of the traveller assembly of this invention to the sailboat deck.

Referring to the drawings, FIG. 1 illustrates the traveller assembly of the present invention installed on a typical sailboat having a hull 10, mast 12 and boom 14 on which the main sail is rigged and having all of the other usual accessories of such a sailboat. A main sail sheet 16 is provided, running around one or more blocks 18 and/or 18A attached to the boom and further attached to the traveller car 20 in order to control the movement of and tension on the boom and permit the boom to be swung out or drawn in.

Figure 2:
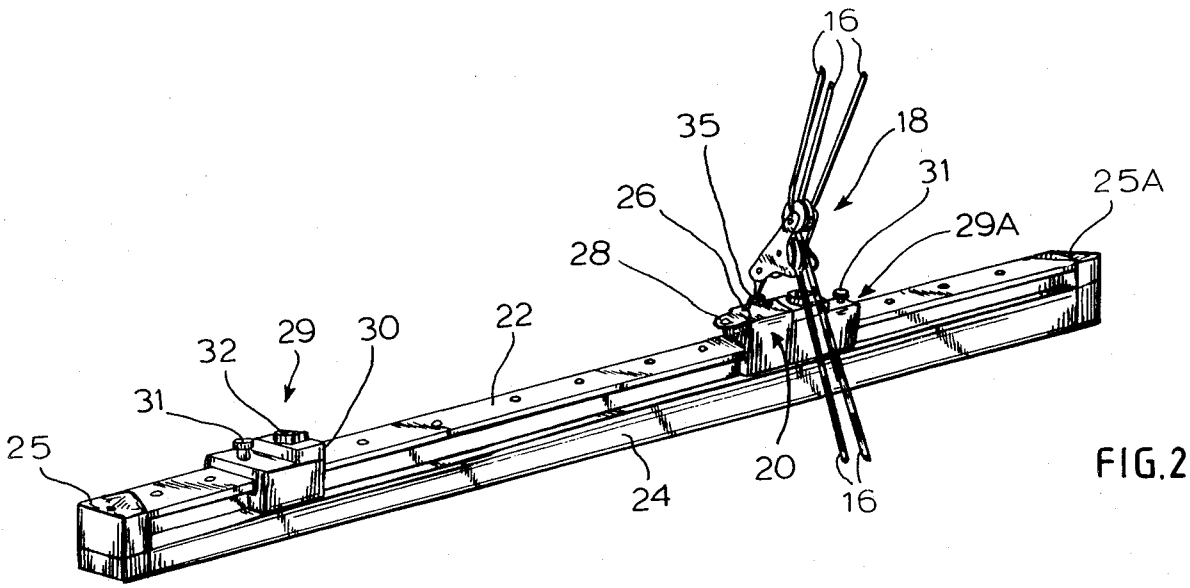
FIG. 2 illustrates an enlarged and detailed view of the traveller assembly of the present invention.
Figure 3:
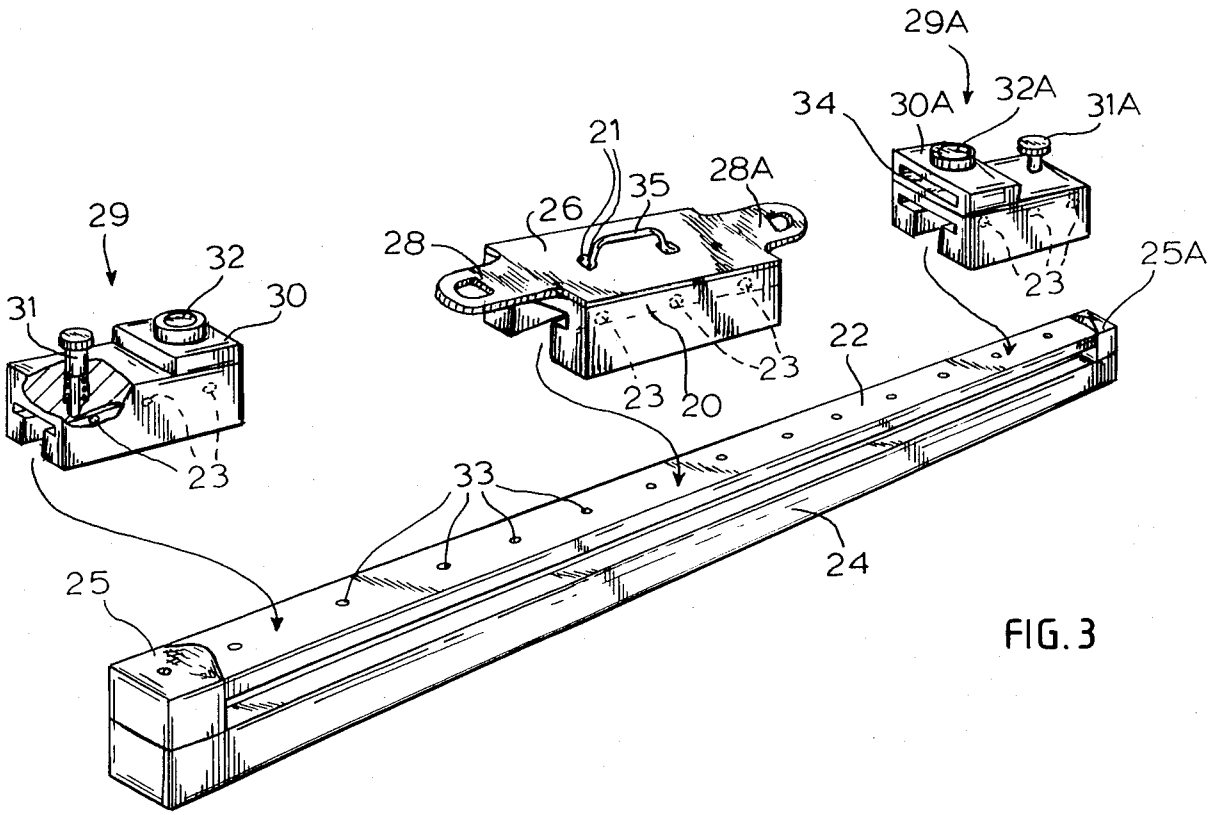
FIG. 3 is an exploded view detailing the various components which comprise the traveller assembly of the present invention.

The traveller assembly and components of the present invention are shown in greater detail in FIGS. 2 and 3. In accordance therewith, the traveller assembly comprises a transverse track way 22 usually formed of metal, preferably rustproof, and may have a variety of different shapes. The track is usually attached to suitable points on the hull at spaced intervals therealong and may be supported by a transverse wooden thwart 24 to which it may be attached to the hull by screws, bolts or the like for extra strength. Removable end caps 25 and 25A are secured at the ends of track 20 which assist in preventing traveller car stops 29 and 29A from sliding off the ends of track 20. A traveller car 20 usually formed of metal, preferably rustproof, or a durable plastic is provided to run to and fro along the track 22. The traveller car 20 may also be of a variety of different designs and may be provided with some form of antifriction means, such as bearings or rollers 23, so as to permit the traveller car 20 to readily run or slide along the track even under substantial load.

In further accordance with the present invention, and in one embodiment thereof as shown in FIGS. 2 and 3, a symmetrical latch plate 26 having, for example, tongue like engageable ends 28 and 28A, is securely mounted by any suitable fastening means, such as screws 21, onto the traveller car 20. Traveller car stops 29 and 29A are provided to slide along the track and are adapted to be secured to the track at pre-selected locations. The traveller car stops may also be of any variety of designs, may be formed of metal or durable plastic and may also be equipped with antifriction means 23. Any suitable means to lock the stops in the selected position may be employed. For example, the stops may be designed with a plunger 31 and 31A that engages a hole 33 provided in the track at uniform distances from the center line. The cut away section in FIG. 3 shows the pin like member of the plunger 31 which engages a hole 33 in the track way. In furtherance of the invention herein, the traveller stops 29 and 29A, are provided with and have secured thereto (e.g. by suitable fasteners) a latching means 30 and 30A, respectively for receiving the respective engageable end 28 or 28A of the latch plate 26. The latching means 30 and 30A have an opening or slot 34 adapted to receive and lock the respective tongue like member 28 or 28A of the latch plate 26 therein. Furthermore, the latching means 30 and 30A are provided with release means 32 and 32A (preferably manual release means) to permit the ready release of the respective latch plate engageable end therefrom. Typical latching means 30 and 30A which may be used herein, include, for example, latching means used in seat belt latching assemblies which have push bottom mechanisms or other release mechanisms to release the engageable tongue-like end therefrom.

Any suitable attachment means 35 may be provided on the upper side of the latch plate 26 for attachment of the main sheet block 18. Attachement means 35 is secured to the latch plate 26 by screws 21 which also secure latch plates 26 to the traveller car 20. In operation, for example, if one is proceeding on starboard tack and the traveller car is held on the windward side by the starboard side stop and one decides to tack, one simply unlocks the latching means 30 (or 30A) by depressing the respective manual release means 32 (or 32A) and proceeds to steer the boat to accomplish the tack. The force on the sail causes the traveller car 20 to move along the track 22 to leeward and cause the engageable end 28 (or 28A) to engage the port stop latching mechanism 30 (or 30A) and lock therein so that when the boat moves past head to wind and the load on the sail is reversed the traveller car will stay in its required position. This procedure is reversed when one decides to go back to starboard tack. Thus, as is readily apparent from the hereinbefore description, the traveller control assembly of the present invention eliminates the necessity to have to secure the traveller car in the new tack position and moreover insures that the traveller car will be in the exact position of the new tack for optimum performance. Furthermore, eliminating the chance of the traveller car moving to the leeward position makes for more efficient tacking with reduced loss in vessel speed.

The foregoing is a description of a preferred embodiment of the invention which is given by way of example only. The invention is not to be taken as limited to any of the specific features as described, but comprehends all such variations thereof as encompassed within the scope of the appended claims.

I claim:

1. A traveller assembly for use on a sailcraft, said traveller assembly comprising:

(i) a track way;

(ii) a traveller car adapted to move to and fro along said track way, said traveller car provided with engaging means; and (iii) stop means adapted to be securred to said track way, said stop means provided with means for receiving and locking said engaging means of said traveller car and said stop means further provided with release means for releasing said engaging means.

2. The traveller assembly according to claim 1 wherein said engaging means is comprised of a latch plate having symmetrical engageable ends, each of said engageable ends adapted to be received by a stop means secured to said track way.

3. The traveller assembly according to claim 2 wherein said symmetrical engageable ends are tongue like members adapted to be received and locked in said stop means.

4. The traveller assembly according to claim 1 wherein said release means is a manual release means.

5. The traveller assembly according to claim 1 wherein said traveller car is further provided with an attachment means for attaching control ropes.

6. The traveller assembly according to claim 1 wherein said traveller car is provided with antifriction means to allow the traveller car to readily move along the track way.

7. The traveller assembly according to claim 1 mounted on a sailcraft.

* * * * *